US009976295B1

(12) United States Patent
Booker, Jr.

(10) Patent No.: US 9,976,295 B1
(45) Date of Patent: May 22, 2018

(54) DOUBLE-TIER DRAIN FILTER SYSTEM

(71) Applicant: Sylvester R. Booker, Jr., Highland Springs, VA (US)

(72) Inventor: Sylvester R. Booker, Jr., Highland Springs, VA (US)

( * ) Notice: Subject to any disclaimer, the term of this patent is extended or adjusted under 35 U.S.C. 154(b) by 0 days. days.

(21) Appl. No.: 15/480,312

(22) Filed: Apr. 5, 2017

(51) Int. Cl.

| | |
|---|---|
| ***E03C 1/122*** | (2006.01) |
| ***E03F 5/16*** | (2006.01) |
| ***E03C 1/264*** | (2006.01) |
| ***B25B 13/50*** | (2006.01) |
| *E03C 1/26* | (2006.01) |
| *E03C 1/302* | (2006.01) |

(52) U.S. Cl.
CPC ..... *E03F 5/16* (2013.01); *B25B 13/50* (2013.01); *E03C 1/264* (2013.01); *E03C 1/302* (2013.01)

(58) Field of Classification Search
CPC ..... E03C 1/2306; E03C 1/264; E03C 1/262; E03C 1/122; E03C 1/14; E03C 1/20; E03C 1/22; E03C 1/26; E03C 1/2665
USPC ..... 4/652, 672, 673, 680, 681, 679, 695, 4/256.1, 286, 287, 288, 289, 290, 292
See application file for complete search history.

(56) References Cited

U.S. PATENT DOCUMENTS

| | | | | |
|---|---|---|---|---|
| 212,614 | A | 2/1879 | Magee | |
| 2,191,686 | A | 2/1940 | Shenk | |
| 2,330,014 | A | 9/1943 | Shenk | |
| 4,005,884 | A * | 2/1977 | Drori | F16L 19/08 285/105 |
| 7,600,644 | B2 | 10/2009 | McCallum | |
| 8,043,497 | B2 | 10/2011 | Silverstein | |
| 8,347,906 | B1 * | 1/2013 | Ismert | E03F 5/0407 137/15.01 |
| 8,505,125 | B1 | 8/2013 | Chia | |
| 9,021,621 | B2 | 5/2015 | Booker, Jr. | |

* cited by examiner

*Primary Examiner* — Allison G Fitzsimmons
(74) *Attorney, Agent, or Firm* — Richard C. Litman

(57) ABSTRACT

The double-tier drain filter system includes an elongate base having an upper section and a lower section. A drain cover with perforations couples to the upper section, and the lower section couples to a drain pipe. Threads are provided between the lower section and the drain pipe to form a threaded interlock. A recess inside the upper section receives a filter assembly which includes a removable, perforated drain basket and a filter element inside the drain basket. An annular mount flange with threads extends from the bottom of the drain cover to thread into the matching inner threads of the drain basket forming another threaded interlock. The drain cover and the filter assembly serves as a double-tier, two-pass filter ranging from coarse to fine filtering, respectively. Tools are provided to facilitate installation and cleaning.

17 Claims, 6 Drawing Sheets

DOUBLE-TIER DRAIN FILTER SYSTEM

BACKGROUND OF THE INVENTION

1. Field of the Invention

The present invention relates to plumbing accessories and particularly to a double-tier drain filter system for secure, removable installation in various drains in residential, commercial, and industrial drains to substantially prevent clogging during normal use.

2. Description of the Related Art

Most conventional drains employ a perforated drain cover that pets nits liquids and other components carried in the liquid, e.g., hair, leftover foodstuffs, soapy wastes, to drain into a main drain pipe. The drain cover acts as a strainer that functions as a rough filter to prevent larger components to pass through the drain cover, and thereby, prevents clogging of the drain pipe to some degree. The conventional drain cover generally fails to prevent accumulation of smaller waste components and oil in the drain pipes. This eventually leads to undesirable clogging.

A solution has been proposed in U.S. Pat. No. 9,021,621, issued to Booker, Jr. (referred to as "Booker, Jr." herein) which is hereby incorporated by reference in its entirety. Booker, Jr. teaches a drain strainer and filter that employs a two-stage filtering of fluids passing through the drain.

There is still a need in the plumbing art to provide a drain system that provides relatively fine filtering of wastes as well as facilitates relatively easy and secure installation of the same. Thus, a double-tier drain filter system solving the aforementioned problems is desired.

SUMMARY OF THE INVENTION

The double-tier drain filter system includes an elongate base having an upper section and a lower section. A drain cover with perforations couples to the upper section, and the lower section couples to a drain pipe. Threads are provided between the lower section and the drain pipe to form a threaded interlock. A recess inside the upper section receives a filter assembly which includes a removable, perforated drain basket and a filter element inside the drain basket. An annular mount flange with threads extends from the bottom of the drain cover to thread into the matching inner threads of the drain basket forming another threaded interlock. The drain cover and the filter assembly serves as a double-tier, two-pass filter ranging from coarse to fine filtering, respectively. Tools are provided to facilitate installation and cleaning.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
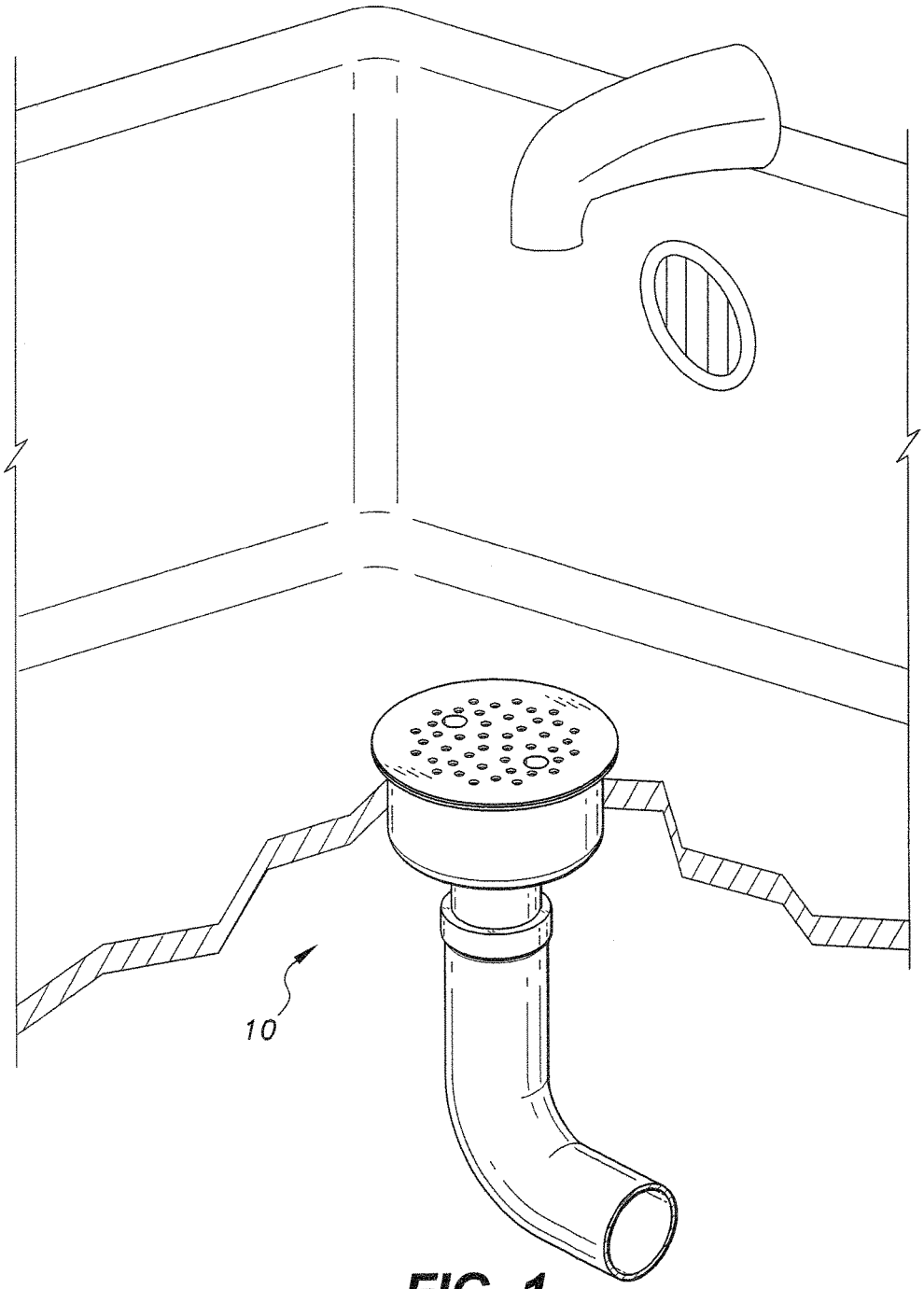
FIG. 1 is an environmental, perspective view of a double-tier drain filter system according to the present invention.
Figure 2:
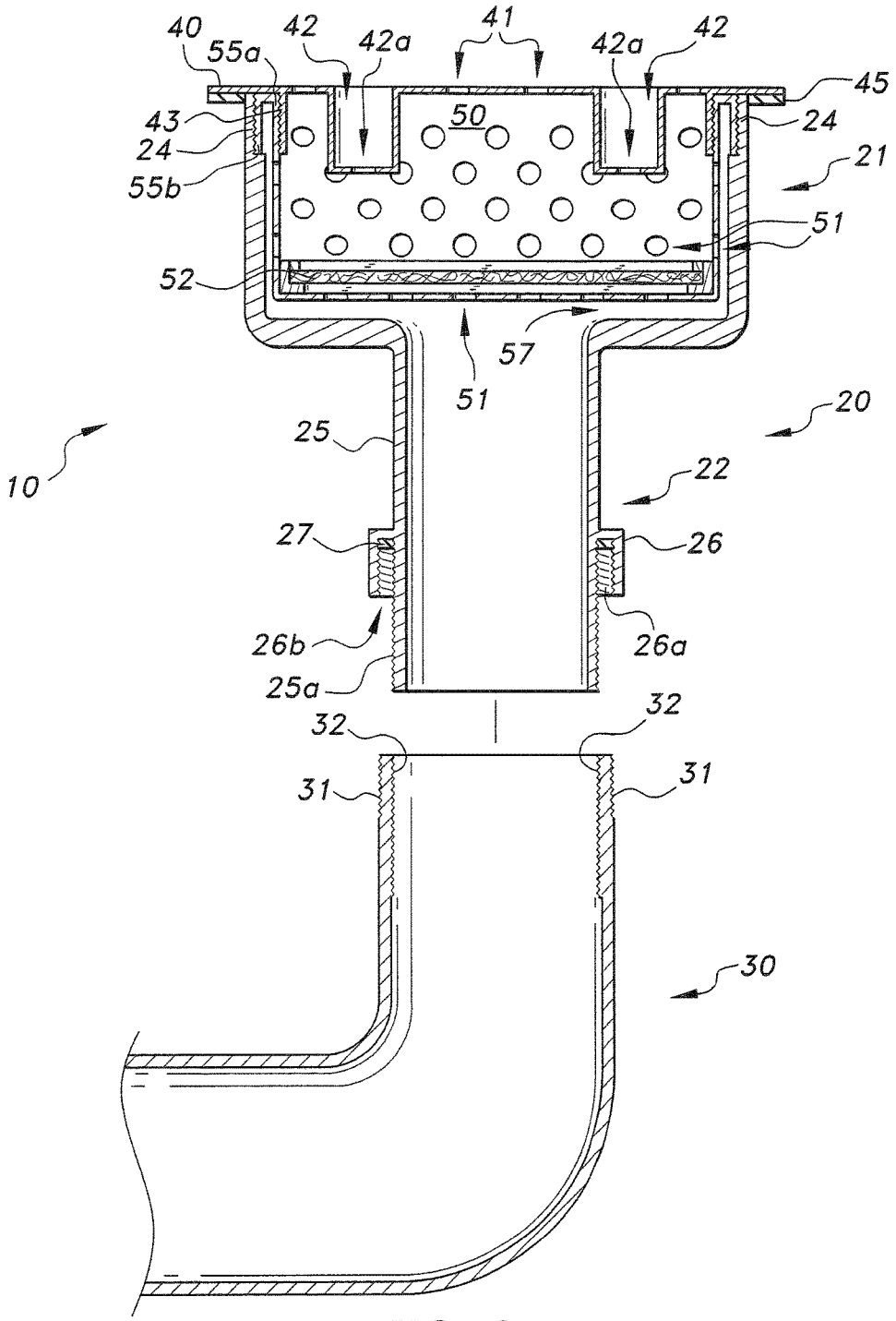
FIG. 2 is a sectional view of the double-tier drain filter system shown in FIG. 1 with a double-tier drain filter exploded from a section of a drain pipe for clarity.
Figure 3:
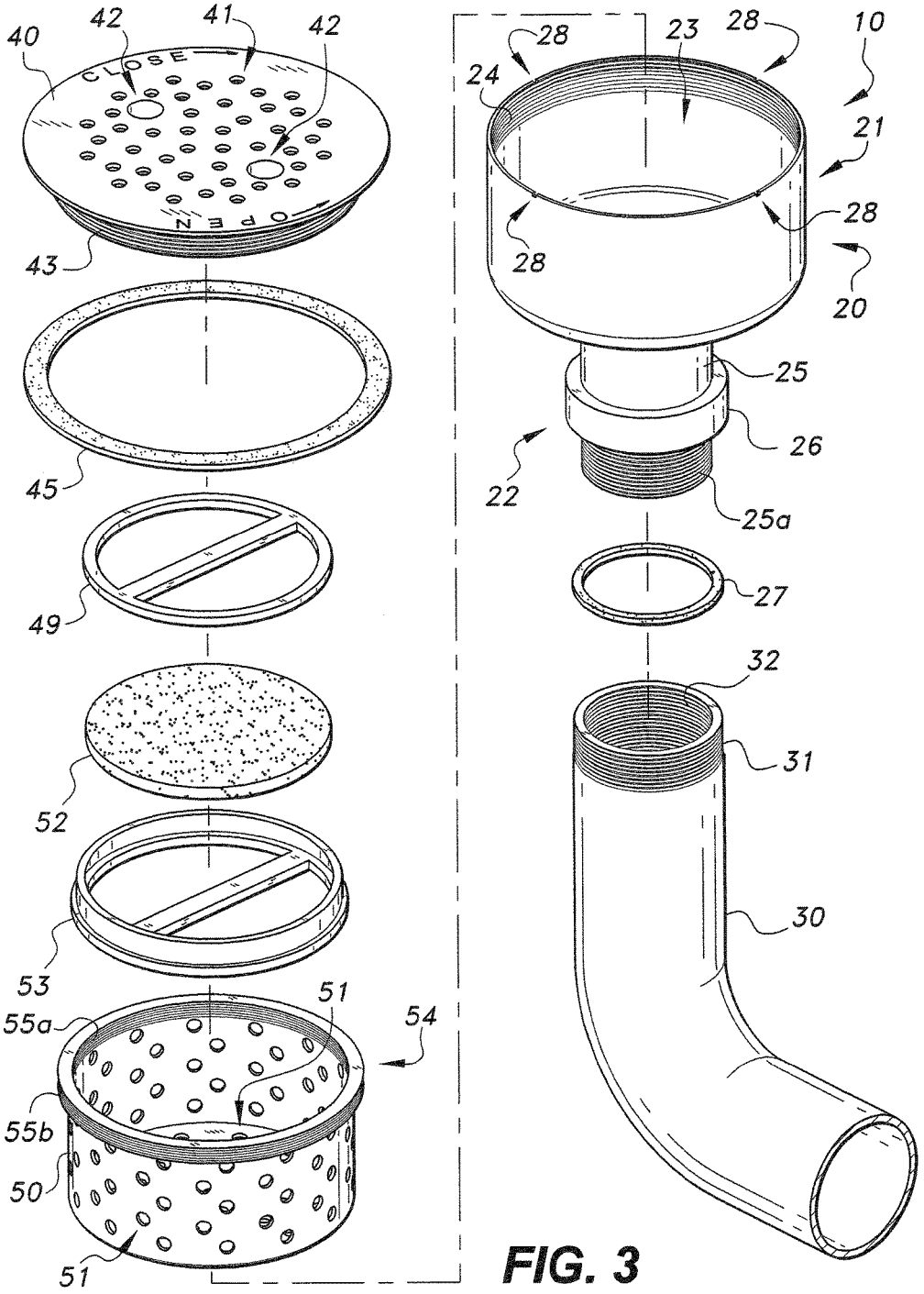
FIG. 3 is an exploded view of the double-tier drain filter system shown in FIGS. 1 and 2.

The double-tier drain filter system, generally referred to by the reference number 10 in the drawings, provides enhanced filtering of dirt, oil, and/or other debris and waste carried in waste liquid flowing to a drain pipe. As shown in FIGS. 1-3, the double-tier drain filter system 10 includes a base 20 selectively coupled to a drain pipe 30, a drain cover 40 selectively capping the base 20, and a two-stage filter system including the drain cover 40.

As best seen in FIGS. 2 and 3, the base 20 includes a generally cup-shaped body having a relatively large or wide upper section 21 and a smaller or narrower lower section 22. The upper section 21 forms a generally circular bowl or recess 23 therein configured to receive other components for filtering. The base 20 includes an annular, inner threads 24 formed on the top, annular ledge thereof. This threaded connection forms a threaded interlock between mating components to insure a secure mounting of these components.

As best seen in FIGS. 2 and 3, the lower section 22 includes an elongate pipe section 25 extending downwardly from the bottom of the upper section 21. The pipe section 25 is preferably unitary with the upper section 21 so as to form a sturdy, uniform, and enduring structure. The pipe section 25 is hollow and preferably smaller in diameter than the upper section 21. One end of the pipe section 25 communicates with the bottom of the upper section 21, defining a drain hole for the double-tier drain filter system 10. The opposite end of the pipe section 25 terminates into an elongate threaded section. This threaded section is provided with outer threads **25*a* for mounting the pipe section 25 to the drain pipe or shoe 30**.

A capped, mount collar 26 extends radially near the bottom end of the pipe section 25, preferably from a point where the outer threads **25*a* at the bottom end of the pipe section 25 begin. The mount collar 26 includes inner threads 26*a* configured to engage outer threads 31 of the drain pipe 30. Preferably, the outer wall of the mount collar 26 extends a relatively short distance so as to not extend past the outer threaded section of the pipe section 25. The mount collar 26 is an integral component and coaxial with the pipe section 25. By this construction, the inner threads 26*a* are spaced from the outer threads 25*a* on the pipe section 25 forming an annular, double-threaded mount groove 26*b*. This double-threaded connection with the drain pipe 30** font's another threaded interlock between mating components to ensure secure mounting of these components and substantially prevent inadvertent loosening of the connection.

Referring to FIGS. 2 and 3, the drain pipe 30 is the main pipe or pipe connector that connects a sink or bathtub to a drain system in a building or residence. To form the threaded interlock described above, the drain pipe 30 includes a mount section for connecting the drain pipe 30 to the base 20, where the mount section is provided with both outer threads 31 and inner threads 32. When assembled, the outer threads 31 of the drain pipe 30 mate with the inner threads 26*a* of the mount cap 26, and the inner threads 32 of the drain pipe 30 mate with the outer threads 25*a* of the pipe section 25. Thus, the mount groove 26*b* has a suitable diameter to fit the mount section of the drain pipe 30. Moreover, the lengths of the outer threads 31 and the inner threads 32 correspond in length to the respective lengths of the inner threads 26*a* and the outer threads 25*a*. A drain pipe seal 27 sits in the ceiling of the mount groove 26*b* in the mount collar 26, and when assembled, rests on the top ledge of the drain pipe 30 to seal the connection between the base 20 and the drain pipe 30 and prevent potential leakage.

Figure 5:
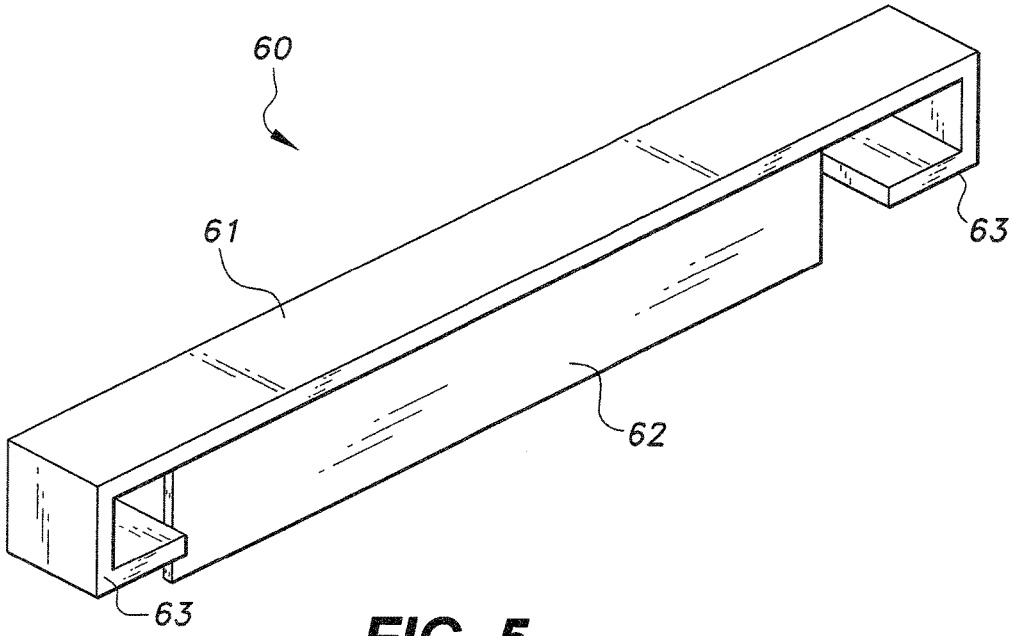
FIG. 5 is a perspective view of a base mounting tool for a base in the double-tier filter system shown in FIGS. 1 and 2.

To assist or ease installation of the base 20 to the drain pipe 30, the double-tier drain filter system 10 includes a base mounting tool 60 as shown in FIG. 5. The base mounting tool 60 includes an elongate handle 61 and an elongate flat screw head 62 depending from one side of the handle 61. The handle 61 is preferably an elongate plate with inwardly curved opposite ends 63 straddling opposite ends of the flat screw head 62. In the embodiment shown, the curved ends 63 are generally C-shaped. The flatness of the handle 61 and the curved ends 63 provide gripping surface and structural strength to withstand the torques experienced by the base mounting tool 60. These features may be constructed in other shapes as long as they provide the necessary structural strength for the installation. The top ledge of the base 20 includes one or more pairs of diametrically opposed, shallow tool notches 28 selectively engaged by the base mounting tool 60 for threading and unthreading operations, i.e., mounting and de-mounting. In use, the distal end of the flat screw head 62 lies across the top of the base 20 to fit inside one of the pairs of opposing tool notches 28 securing the base mounting tool 60 thereon for subsequent threading or unthreading.

Figure 4:
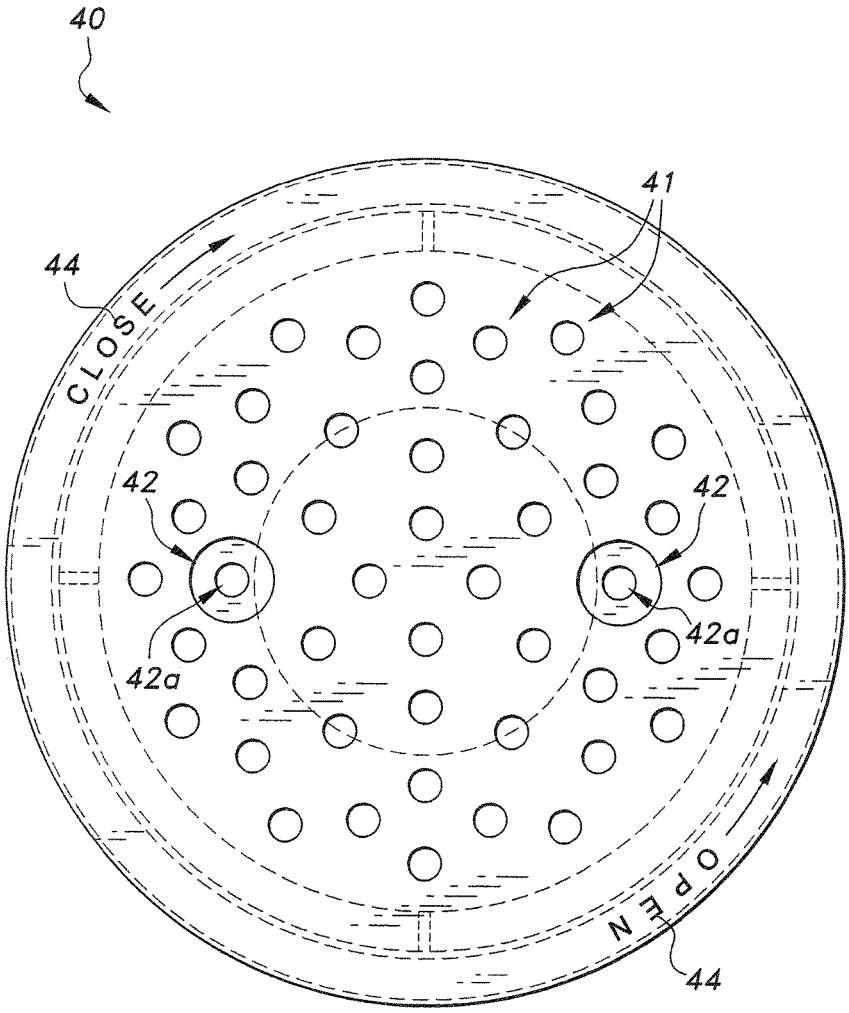
FIG. 4 is a plan view of a drain cover in the double-tier drain filter system shown in FIGS. 1 and 2.

As best seen in FIGS. 2-4, the drain cover 40 is preferably a generally circular disk with perforations 41 thereon. By this construction, the perforations 41 serve as a first drain filter or first tier filter in the double-tier drain filter system 10. A pair of spaced tool recesses 42 is formed on top of the drain cover 40 that extend down to a predetermined depth. The bottom or floor of each tool recess 42 may be provided with a drain hole 42*a* to enable liquids to flow through into the base 20 in the same manner as through the perforations 41. Otherwise, such liquids may accumulate inside the tool recesses 42 leaving behind undesirable dirt, grime, and other residue over time. The drain cover 40 also includes an annular mount flange extending downward from the bottom of the drain cover 40, the annular mount flange including outer threads 43.

The diameter of the drain cover 40 is preferably larger than the diameter of the upper section 21 of the base 20 so that a generally narrow, circular edge portion of the drain cover 40 extends beyond the upper edge of the upper section 21. This edge portion of the drain cover 40 can be devoid of perforations. As such, the perforations 41 are centered or concentrated over the opening of the upper section 21 when assembled. An annular drain seal 45 is mounted between a lower surface of this edge portion and a surface on which the double-tier filter system 10 is installed, e.g., the surrounding surface of a drain opening at the bottom of the bathtub. When assembled, the drain seal 45 prevents undesirable leaks into the area around the base 20 and the drain pipe 30 that may lead to potential water damage and the like.

Figure 6:
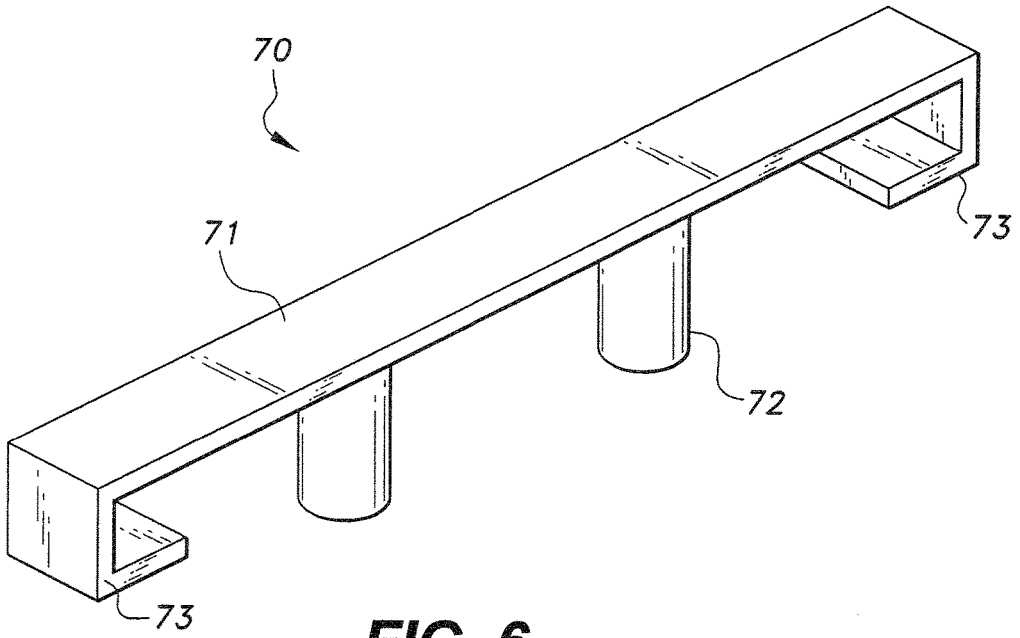
FIG. 6 is a perspective view of a drain cover mounting tool for a drain cover in the double-tier filter system shown in FIGS. 1 and 2.

To assist or ease installation of the drain cover 40 over the base 30, the double-tier drain filter system 10 includes a drain cover mounting tool 70 as shown in FIG. 6. The drain cover mounting tool 70 includes an elongate handle 71 and a pair of spaced key posts 72 depending from one side of the handle 71. The handle 71 is preferably an elongate plate including inwardly curved opposite ends 73 and one or more key posts 72 between the ends 73. In the embodiment shown, the curved ends 73 are generally C-shaped. The flatness of the handle 71 and the curved ends 73 provide gripping surface and structural strength to withstand the torques experienced by the drain cover mounting tool 70. These features may be constructed in other shapes as long as they provide the necessary structural strength for the installation. In use, the key posts 72 are selectively inserted into corresponding tool recesses 42 to secure the drain cover mounting tool 70 thereon for subsequent threading or unthreading. As best seen in FIG. 4, the drain cover 40 may include indicia 44, such as "CLOSE" and "OPEN," with directional arrows along the edge portion to indicate turning direction for mounting or removing the drain cover 40.

The mount recesses 42 include through-holes of suitable diameter to receive the key posts 72. The mounting and removal operations may be performed in the same manner with the drain cover mounting tool 70 except that the curved ends 73 may serve as stops to prevent the key posts 72 from extending too far into the through-holes, e.g., when the ends 73 contact the drain cover 40.

The drain cover 40 serves as a first pass filter. As best seen in FIG. 2, the double-tier drain system 10 is provided with a filter assembly disposed inside the upper section 21 of the base 20 which serves as a second pass filter. A drain basket 50 is disposed inside the recess 23 in the upper section 21 of the base 20. The drain basket 50 serves to capture any additional solid or other waste component in the liquid waste material that flows from the drain cover 40. The drain basket 50 includes a perforated peripheral wall and a perforated floor extending across a bottom end of the wall. Perforations 51 in the peripheral wall and floor of the basket 50 allow the liquid flowing into the recess 23 to pass through to the drain hole in the pipe section 25.

The drain basket 50 includes an upper portion 54 having inner threads 55*a* and outer threads 55*b*. When assembled, the inner threads 55*a* of the upper portion 54 of the drain basket 50 are configured for forming a threaded interlock where the outer threads 43 of the annular mount flange extending downward from the bottom of the drain cover 40 mate with the inner threads 55*a* of the upper portion 54 of the drain basket 50. The outer threads 55*b* of the upper portion 54 of the drain basket 50, on the other hand, are configured for forming a threaded interlock with the upper section 21. For example, the outer threads 55*b* of the drain basket 50 mate with inner threads 24 of the upper section 21 of the base 20. The interlock between the drain basket 50 and the base 20 create a gap 57 therebetween to allow for efficient water flow.

A removable filter element 52 is disposed on the drain basket 50 floor to capture grease and/or relatively smaller particles flowing in the liquid. For example, the filter element 52 can be configured to attract grease and oil, while allowing water to flow freely through the filter element 52. The filter element 52 is preferably a circular disk of filter material. It is to be noted that the filter element 52 is not meant to be washable or reuseable, but simply disposed and replaced after a predetermine amount of time. The filter element 52 can be positioned (e.g. encased) in between an upper filter retainer 49 and a lower filter retainer 53 as described in U.S. Pat. No. 9,021,621 B2, which is hereby incorporated by reference in its entirety, so as to keep the filter element 52 in place during use. For example, once the filter element 52 is positioned between the upper filter retainer 49 and the lower filter retainer 53, the upper filter retainer 49, the lower filter retainer 53, and the filter element 52 captured therebetween can be positioned within the drain basket 50 on the perforated floor of the drain basket 52, as illustrated in FIG. 2. Alternatively, the filter element 52 can be constructed and dimensioned to fit snugly within the drain basket 50 to keep the filter element 52 in place during use.

Figure 7:
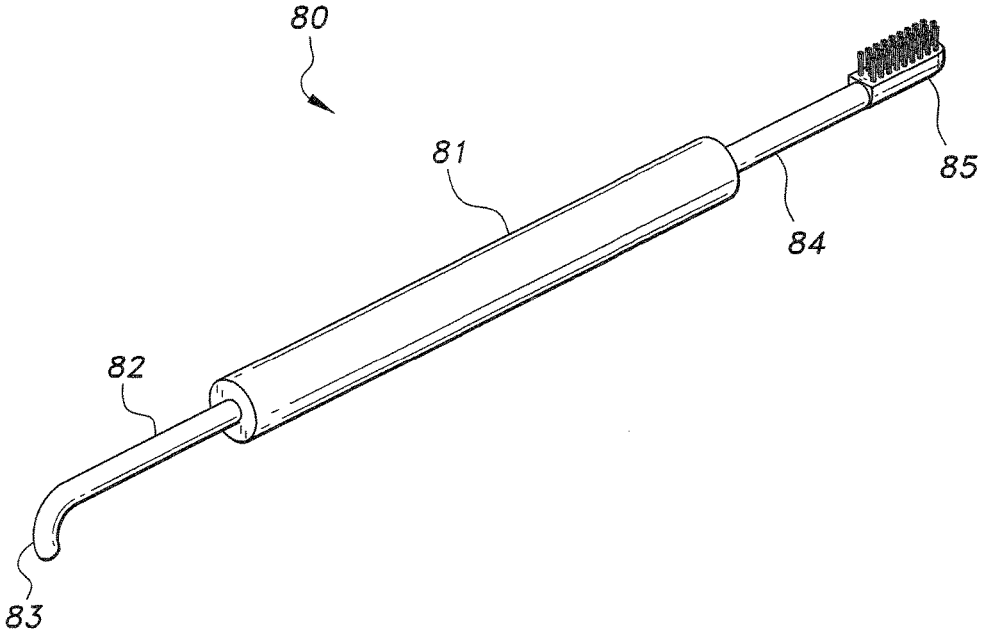
FIG. 7 is a perspective view of a maintenance tool for the double-tier filter system shown in FIGS. 1 and 2.

The drain filter system 10 includes a maintenance tool 80 shown in FIG. 7. The maintenance tool 80 includes an elongate handle 81 and a tool implement extending from each end of the handle 81. The handle 81 is preferably an elongate circular bar or beam. One end is provided with a curved hook 83 extending from a distal end of an elongate hook post 82. The opposite end is provided with a brush 85 extending from a distal end of an elongate brush post 84. The hook 83 is configured to fit into one of the perforations 51 on the drain basket 50 to allow a user to remove the drain basket 50 from the recess 23. The brush 85 enables the user to brush away accumulations inside the drain basket 50 as well as the filter element 52.

Thus, it can be seen that the double-tier drain system 10 provides enhanced filtering of draining liquids vis-à-vis the drain cover 40 and the drain basket 50 with the filter element 52. The threaded interlock securely connects the drain cover 40 to the drain basket 50, the drain basket 50 to the base 20, and the base 20 to the drain pipe 30; thereby preventing inadvertent loosening of the connections and even serves as a childproof feature. Moreover, the base mounting tool 60, the drain cover mounting tool 70, and the maintenance tool 80 enable relatively easy installation and maintenance of the double-tier drain system 10.

It is to be understood that the double-tier drain system 10 encompasses a variety of alternatives. For example, the various components may be constructed from materials used in plumbing appliances. Moreover, the handles 61, 71, 81 may be provide with grip enhancing features such as protrusions, knurled patterns, and/or layer of friction enhancing material. Furthermore, the double-tier drain system 10 may be constructed without the drain pipe 30 such that the necessary threading may be formed on existing drain pipes to mount the base 20 thereon.

It is to be understood that the present invention is not limited to the embodiments described above, but encompasses any and all embodiments within the scope of the following claims.

I claim:

1. A double-tier drain filter system, comprising:

an elongate base having an upper section and a lower section, the upper section having a diameter larger than the lower section and inner threads formed on a top ledge thereof, the lower section having a tubular pipe section depending therefrom;

wherein said upper section comprises at least one pair of spaced tool notches formed on said top ledge of said upper section;

a recess formed inside the upper section;

a removable filter assembly disposed inside the recess, the filter assembly having a drain basket;

a removable drain cover selectively coupled to the drain basket, the drain cover having an annular mount flange adapted to mount the drain cover inside the drain basket of the filter assembly;

a drain seal disposed on a bottom surface of the drain cover;

a mount collar at a bottom end of the pipe section and radially extending therefrom, the mount collar having an annular sidewall spaced from the pipe section defining an annular mount groove for receiving a top portion of a drain pipe; and a drain pipe seal disposed within the mount groove to seal a connection between the lower section and the drain pipe;

whereby the drain cover and the filter assembly form a double-tier, two-pass filter to filter different-sized waste particles carried in liquid flowing to the drain pipe.

2. The double-tier drain filter system according to claim 1, further comprising:

inner threads along the upper section of the base; and outer threads along the upper portion of the drain basket for mating with the inner threads of the base, wherein a gap is formed between the base and the drain basket when the outer threads of the of the drain basket are mated with the inner threads of the base.

3. The double-tier drain filter system according to claim 2, wherein said drain cover comprises:

a circular disk having a plurality of perforations extending through a central portion and a continuous peripheral edge, said circular disk having a diameter greater than said upper section, said drain seal being disposed on a bottom surface of said peripheral edge; and a pair of spaced tool recesses formed on the circular disk extending downwardly to a predetermined depth, the tool recesses adapted to receive a tool for removable mounting of said circular disk to said upper section of said base.

4. The double-tier drain filter system according to claim 3, wherein a bottom end of each tool recess includes at least one perforation defined therethrough.

5. The double-tier drain filter system according to claim 3, further comprising indicia disposed along said peripheral edge, said indicia indicating rotating direction for mounting and removal of said drain cover from said upper section.

6. The double-tier drain filter system according to claim 3, further comprising a drain cover mounting tool to selectively mount or remove said drain cover.

7. The double-tier drain filter system according to claim 6, wherein said drain cover mounting tool comprises;

an elongate handle having opposed curved ends; and a pair of elongate key posts extending downward from said handle, said key posts disposed between said curved ends, said key posts adapted to engage said tool recesses on said drain cover and secure said drain cover mounting tool for mounting or removal operations.

8. The double-tier drain filter system according to claim 1, further comprising a base mounting tool to selectively mount or remove said base from said drain pipe.

9. The double-tier drain filter system according to claim 8, wherein said base mounting tool comprises;

an elongate handle having opposed curved ends; and an elongate flat screw head extending downward from said handle, said flat screw head disposed between said curved ends, said flat screw head adapted to engage said tool notches on said upper section and secure said base mounting tool for subsequent mounting or removal operations.

10. The double-tier drain filter system according to claim 1, further comprising a drain pipe, wherein said drain pipe comprises one end having inner threads and outer threads.

11. The double-tier drain filter system according to claim 10, wherein said pipe section comprises:

one end communicating with said recess in said upper section; and an opposite end having outer threads, said mount collar having inner threads spaced from said outer threads on said pipe section, said inner threads on said mount collar and outer threads on said pipe section defining sidewalls of said mount groove on said lower section, said inner threads on said mount collar adapted to mate with said outer threads on said drain pipe and said outer threads on said pipe section adapted to mate with inner threads on said drain pipe, the threaded connection forming a threaded interlock securing said base to said drain pipe.

12. The double-tier drain filter system according to claim 1, wherein said filter assembly comprises:

a perforated drain basket removably disposed inside said recess in said upper section; and a filter element disposed inside said drain basket, said filter element facilitating filtering of finer waste material flowing into said recess from said drain cover.

13. The double-tier drain filter system according to claim 1, further comprising a maintenance tool to selectively clean said filter assembly.

14. The double-tier drain filter system according to claim 13, wherein said maintenance tool comprises:

an elongate handle having opposing ends; and a tool implement extending from each end, each tool implement being different from the other.

15. The double-tier drain filter system according to claim 14, wherein said tool implements comprises:

an elongate hook post extending from one end of said handle and a hook at a distal end of hook post, said hook adapted to selectively remove said filter assembly from said upper section; and an elongate brush post extending from the opposite end of said handle and a brush at a distal end of said brush post, said brush adapted to clean wastes from said filter assembly.

16. A double-tier drain filter system, comprising:

an elongate base having an upper section and a lower section, the upper section having a diameter larger than the lower section, the lower section having a pipe section;

wherein said upper section comprises at least one pair of spaced tool notches formed on said top ledge of said upper section;

a recess formed inside the upper section;

a filter assembly disposed inside the recess, the filter assembly having a drain basket;

a removable drain cover selectively coupled to the drain basket, the drain cover having an annular mount flange adapted to mount the drain cover inside the drain basket of the filter assembly;

a drain seal disposed between the drain cover and a mount surface for the double-tier filter system;

a drain pipe;

a capped mount collar coaxial with the pipe section and radially extending therefrom, the mount collar having an annular sidewall spaced from the pipe section defining an annular mount groove, the annular mount groove on the pipe section adapted to mount the base to the drain pipe; and a drain pipe seal disposed inside the mount groove on the lower section to seal connection between the lower section and the drain pipe to prevent potential leaks;

wherein the drain cover and the filter assembly form a double-tier, two-pass filter to filter coarse and fine waste material, respectively.

17. The double-tier drain filter system according to claim 14, comprising a threaded interlock between said upper section of said base and said drain basket and a threaded interlock between said drain cover and drain basket.

* * * * *